US009156480B2

(12) United States Patent
Morimoto

(10) Patent No.: US 9,156,480 B2
(45) Date of Patent: Oct. 13, 2015

(54) IN-VEHICLE INFORMATION PROVIDING APPARATUS

(75) Inventor: Kazunari Morimoto, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 14/356,930

(22) PCT Filed: Dec. 19, 2011

(86) PCT No.: PCT/JP2011/079368
§ 371 (c)(1),
(2), (4) Date: May 8, 2014

(87) PCT Pub. No.: WO2013/093996
PCT Pub. Date: Jun. 27, 2013

(65) Prior Publication Data

US 2014/0324346 A1 Oct. 30, 2014

(51) Int. Cl.
*B61L 25/08* (2006.01)
*H04M 11/08* (2006.01)
*B61L 15/00* (2006.01)

(52) U.S. Cl.
CPC ..... *B61L 15/0045* (2013.01); *B61L 15/009* (2013.01); *B61L 15/0072* (2013.01); *B61L 15/0036* (2013.01)

(58) Field of Classification Search
CPC combination set(s) only.
See application file for complete search history.

(56) References Cited

U.S. PATENT DOCUMENTS

2011/0029166 A1* 2/2011 Iga et al. ..... 701/19
2011/0131522 A1 6/2011 Nagai

FOREIGN PATENT DOCUMENTS

CN 102112357 A 6/2011
EP 2500235 A1 9/2012
EP 2641808 A1 9/2013

(Continued)

OTHER PUBLICATIONS

International Search Report (PCT/ISA/210) mailed on Mar. 19, 2012, by the Japanese Patent Office as the International Searching Authority for International Application No. PCT/JP2011/079368.

(Continued)

*Primary Examiner* — Thomas Tarcza
*Assistant Examiner* — Edward Pipala
(74) *Attorney, Agent, or Firm* — Buchanan Ingersoll & Rooney PC

(57) ABSTRACT

An in-vehicle information providing apparatus includes a storage unit that stores therein a station-facility image management table in which station-facility image selection conditions including at least a station name, a traveling direction, and a door opening direction are associated with station facility images, and a station-facility image database in which a plurality of station facility images corresponding to the station-facility image selection conditions are registered for each station. The in-vehicle information providing apparatus further includes an image-display control unit that selects, from the station-facility image database, a station facility image in which train information acquired from a train information management apparatus matches with the station-facility image selection conditions, by referring to the station-facility image management table, and transmits the selected station facility image as station-facility image information to the respective display units.

16 Claims, 6 Drawing Sheets

(56) References Cited

FOREIGN PATENT DOCUMENTS

| | | | |
|---|---|---|---|
| JP | 10-324244 | A | 12/1998 |
| JP | 2002-287722 | A | 10/2002 |
| JP | 2003-95105 | A | 4/2003 |
| JP | 2006-118908 | A | 5/2006 |
| JP | 2007-283991 | A | 11/2007 |
| JP | 2010-260518 | A | 11/2010 |
| JP | 4827992 | B1 | 11/2011 |
| JP | 2011-245891 | A | 12/2011 |
| WO | 2011058638 | A1 | 5/2011 |

OTHER PUBLICATIONS

Written Opinion (PCT/ISA/237) mailed on Mar. 19, 2012, by the Japanese Patent Office as the International Searching Authority for International Application No. PCT/JP2011/079368.

Office Action (First Office Action) issued on Apr. 1, 2015, by the Chinese Patent Office in corresponding Chinese Patent Application No. 201180075595.1, and a partial English Translation of the Office Action. (10 pages).

Extended European Search Report issued on Jul. 14, 2015 by the European Patent Office, in corresponding European Patent Application No. 11878091.5. (6 pages).

* cited by examiner (a) ISLAND PLATFORM (b) SEPARATE PLATFORMS (c) OTHER PLATFORMS (a) STATION FACILITY IMAGE IN DOOR OPENING DIRECTION (b) STATION FACILITY IMAGE ON OPPOSITE SIDE TO DOOR OPENING DIRECTION

FIG.7

| STATION-FACILITY IMAGE DATA NUMBER | SIDE 1 | | SIDE 2 | |
|---|---|---|---|---|
| 1 | NEXT STOP STATION A<br>STAIRS EV TICKET GATE<br>1 2 3 4 5 6 | 601a | NEXT STOP STATION A<br>6 5 4 3 2 1<br>TICKET GATE EV STAIRS | 601b |
| 2 | NEXT STOP STATION A<br>1 2 3 4 5 6<br>STAIRS EV TICKET GATE | 602a | NEXT STOP STATION A<br>TICKET GATE EV STAIRS<br>6 5 4 3 2 1 | 602b |
| 3 | NEXT STOP STATION A<br>1 2 3 4 5 6<br>STAIRS EV TICKET GATE | 603a | NEXT STOP STATION A<br>TICKET GATE EV STAIRS<br>6 5 4 3 2 1 | 603b |
| 4 | NEXT STOP STATION A<br>STAIRS EV TICKET GATE<br>1 2 3 4 5 6 | 604a | NEXT STOP STATION A<br>6 5 4 3 2 1<br>TICKET GATE EV STAIRS | 604b |
| 5 | NEXT STOP STATION B<br>1 2 3 4 5 6<br>EV TICKET GATE | 605a | NEXT STOP STATION B<br>TICKET GATE EV<br>6 5 4 3 2 1 | 605b |
| 6 | NEXT STOP STATION B<br>EV TICKET GATE STAIRS<br>1 2 3 4 5 6 | 606a | NEXT STOP STATION B<br>6 5 4 3 2 1<br>STAIRS TICKET GATE EV | 606b |
| 7 | NEXT STOP STATION B<br>EV TICKET GATE STAIRS<br>1 2 3 4 5 6 | 607a | NEXT STOP STATION B<br>6 5 4 3 2 1<br>STAIRS TICKET GATE EV | 607b |
| 8 | NEXT STOP STATION B<br>1 2 3 4 5 6<br>EV TICKET GATE | 608a | NEXT STOP STATION B<br>TICKET GATE EV<br>6 5 4 3 2 1 | 608b |
| 9 | NEXT STOP STATION C<br>STAIRS EV<br>1 2 3 4 5 6 | 609a | NEXT STOP STATION C<br>6 5 4 3 2 1<br>EV STAIRS | 609b |
| 10 | NEXT STOP STATION C<br>STAIRS EV<br>1 2 3 4 5 6 | 610a | NEXT STOP STATION C<br>6 5 4 3 2 1<br>EV STAIRS | 610b |
| 11 | NEXT STOP STATION C<br>STAIRS EV TICKET GATE<br>1 2 3 4 5 6 | 611a | NEXT STOP STATION C<br>6 5 4 3 2 1<br>TICKET GATE EV STAIRS | 611b |
| ⋮ | ⋮ | | ⋮ | |

FIG.8

| STATION-FACILITY IMAGE DATA NUMBER | NEXT STATION NAME | TRAVELING DIRECTION | STARTING FLAG | DESTINATION STATION NAME | DOOR OPENING DIRECTION |
|---|---|---|---|---|---|
| 1 | STATION A | UPBOUND | | | SIDE 1 |
| 2 | STATION A | DOWNBOUND | | | SIDE 2 |
| 3 | STATION A | UPBOUND | | | SIDE 2 |
| 4 | STATION A | DOWNBOUND | | | SIDE 1 |
| 5 | STATION B | UPBOUND | | | SIDE 2 |
| 6 | STATION B | DOWNBOUND | | | SIDE 1 |
| 7 | STATION B | UPBOUND | | | SIDE 1 |
| 8 | STATION B | DOWNBOUND | | | SIDE 2 |
| 9 | STATION C | DOWNBOUND | | STATION Z | SIDE 1 |
| 10 | STATION C | DOWNBOUND | | STATION Y | SIDE 1 |
| 11 | STATION C | DOWNBOUND | YES | | SIDE 1 |
| ⋮ | ⋮ | ⋮ | ⋮ | ⋮ | ⋮ |

IN-VEHICLE INFORMATION PROVIDING APPARATUS

FIELD

The present invention relates to an in-vehicle information providing device.

BACKGROUND

In an in-vehicle information providing apparatus that displays destination, stops, connection guidance, and the like on an LCD display installed in a vehicle of a train as a display medium based on information from a train information management apparatus, pieces of information such as destination guidance of the train, next stop guidance, estimated arrival time, difference of stops due to train type differences, door opening direction guidance at the next stop, and station guidance at the next stop are generally displayed. Among these pieces of information, with regard to the station guidance at the next stop, generally, the content to be displayed is not uniquely determined. Therefore, the display content needs to be determined by some method.

Conventionally, for example, a technique of displaying guidance information on an in-vehicle display in cooperation with a ground device such as an ATS (Automatic Train Stop) (for example, Patent Literature 1), and a technique of holding information such as route name, mileage chart, and arrival platform (platform) in a database to display guidance such as stairs for transfer by using the database (for example, Patent Literature 2) have been disclosed.

CITATION LIST

Patent Literatures

Patent Literature 1: Japanese Patent Application Laid-open No. 2010-260518

Patent Literature 2: Japanese Patent Application Laid-open No. 2007-283991

SUMMARY

Technical Problem

However, according to the technique described in Patent Literature 1, it is required to cooperate with a ground device such as the ATS and a computer-aided traffic control system. Therefore, there is a problem in that a large-scale system needs to be established, thus being costly. Further, according to the technique described in Patent Literature 2, an arrival platform of a train and the like need to be held beforehand. Therefore, there is a problem in that when a situation different from the pre-held information occurs (for example, when a train arrives at a platform different from the platform as previously scheduled), different information may be displayed.

The present invention has been achieved in order to solve the above problems, and an object of the present invention is to provide an in-vehicle information providing apparatus that can display more reliable station facility information without establishing any large-scale system.

Solution to Problem

The present invention is directed to an in-vehicle information providing apparatus that achieves the object. The in-vehicle information providing apparatus causes a plurality of display units installed in a vehicle to display a station facility image of a next station. The in-vehicle information providing apparatus includes a storage unit that stores therein a station-facility image management table in which station-facility image selection conditions including at least a station name, a traveling direction, and a door opening direction are associated with the station facility image, and a station-facility image database in which a plurality of station facility images corresponding to the station-facility image selection conditions are registered for each station. The in-vehicle information providing apparatus further includes an image-display control unit that selects, from the station-facility image database, the station facility image in which train information acquired from a train information management apparatus matches with the station-facility image selection conditions, by referring to the station-facility image management table, and transmits the selected station facility image as station-facility image information to the respective display units.

Advantageous Effects of Invention

According to the present invention, it is possible to display more reliable station facility information without establishing any large-scale system.

BRIEF DESCRIPTION OF DRAWINGS

FIG. 7 is an example of the station-facility image database according to the present embodiment.

FIG. 8 is an example of a station-facility image management table according to the present embodiment.

DESCRIPTION OF EMBODIMENTS

Exemplary embodiments of an in-vehicle information providing device according to the present invention will be explained below in detail with reference to the accompanying drawings. The present invention is not limited to the embodiments.

Embodiment

Figure 1:
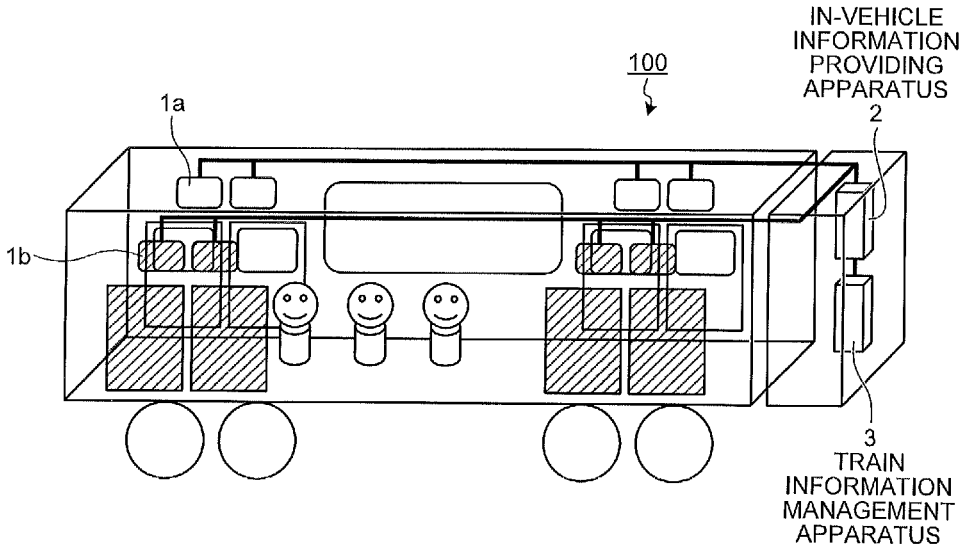
FIG. 1 is an example of an in-vehicle information providing apparatus and a configuration of an apparatus connected to the in-vehicle information providing apparatus according to an embodiment of the present invention.

FIG. 1 is an example of an in-vehicle information providing apparatus and a configuration of an apparatus connected to the in-vehicle information providing apparatus according to an embodiment of the present invention. As shown in FIG. 1, display units 1*a* and 1*b* are respectively installed at a door header above a door in respective vehicles of a train 100. For example, an in-vehicle information providing apparatus 2 and a train information management apparatus 3 are installed in a first vehicle of the train.

Figure 2:
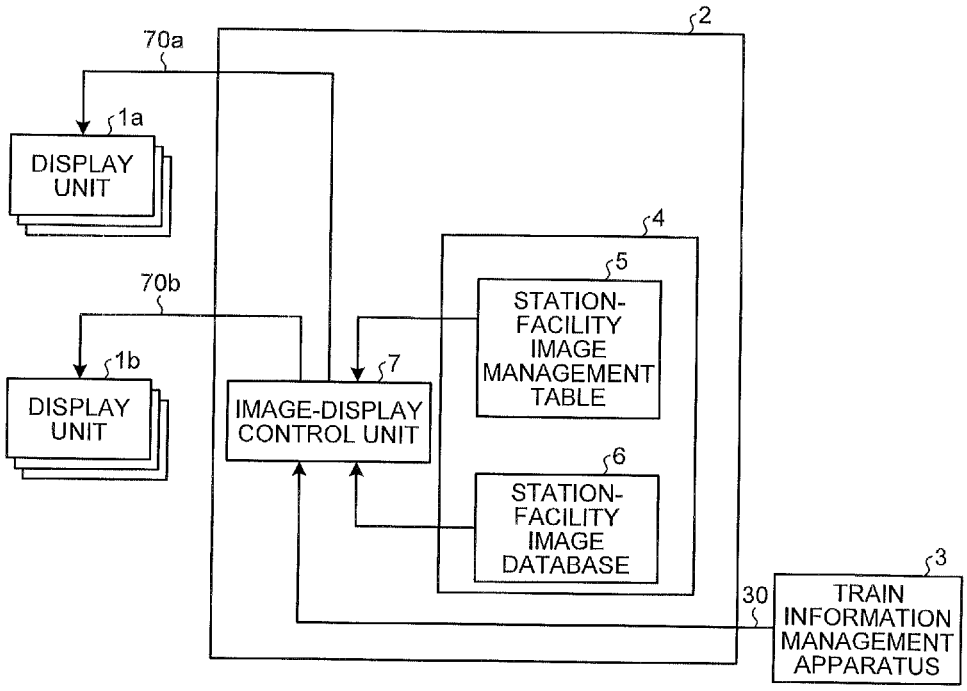
FIG. 2 is a configuration example of the in-vehicle information providing apparatus according to the present embodiment.

FIG. 2 is a configuration example of the in-vehicle information providing apparatus according to the present embodiment. As shown in FIG. 2, the in-vehicle information providing apparatus 2 according to the present embodiment includes a storage unit 4 in which a station-facility image management table 5 and a station-facility image database 6 are stored and held, and an image-display control unit 7. A plurality of display units 1*a* and 1*b* installed in respective vehicles and the train information management apparatus 3 are connected to the in-vehicle information providing apparatus 2.

The display units 1*a* and 1*b* are provided corresponding to one side and the other side of each vehicle to display a station facility image of the next station for passengers on the train 100. The display unit 1*a* receives a station facility image as seen in a direction in which the display unit 1*a* is seen from the inside of the vehicle from the in-vehicle information providing apparatus 2 and displays the image as station-facility image information 70*a*.

The display unit 1*b* also receives a station facility image as seen in a direction in which the display unit 1*b* is seen from the inside of the vehicle, as station-facility image information 70*b* from the in-vehicle information providing apparatus 2, and displays the image. That is, arrangement of respective station facilities displayed on the display unit 1*a* and arrangement of respective station facilities displayed on the display unit 1*b* are mirror images to each other.

The train information management apparatus 3 has functions of collecting states of the respective devices in the train 100, and of managing various pieces of information required for controlling the train such as formation control of power running/braking, door opening/closing commands, air-conditioning, train announcement, and interior lighting control. The train information management apparatus 3 also has a function of receiving input of information related to the operation of the train 100 such as the destination from a driver or a conductor. The train information management apparatus 3 includes, for example, a touch panel (not shown) or a switch (not shown) as a unit that receives input from the driver or the conductor. According to the present embodiment, the train information management apparatus 3 outputs train information 30 including at least the next station name, traveling direction, and door opening direction at the next station to the in-vehicle information providing apparatus 2.

In the station-facility image management table 5, station-facility image selection conditions including at the least station name, traveling direction, and door opening direction at the station are associated with the station facility image.

In the station-facility image database 6, a plurality of station facility images corresponding to the station-facility image selection conditions are registered for each station. According to the present embodiment, the station facility image displayed on the display unit 1*a* and the station facility image displayed on the display unit 1*b* are registered in a pair, corresponding to one station-facility image selection condition.

The image-display control unit 7 refers to the station-facility image management table 5 to select, from the station-facility image database 6, a station facility image in which the train information 30 output from the train information management apparatus 3 matches with the station-facility image selection conditions, and transmits, as the station-facility image information 70*a*, the station facility image to be displayed on the respective display units 1*a*, and transmits, as the station-facility image information 70*b*, the station facility image to be displayed on the respective display units 1*b*.

Figure 3:
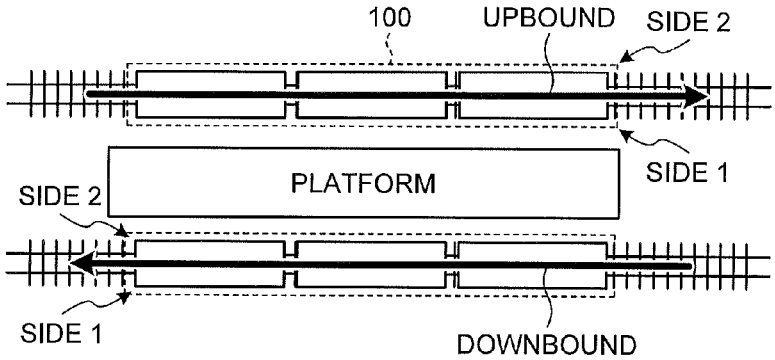
FIG. 3 are examples of a platform configuration of a station explained in the present embodiment.
Figure 3:
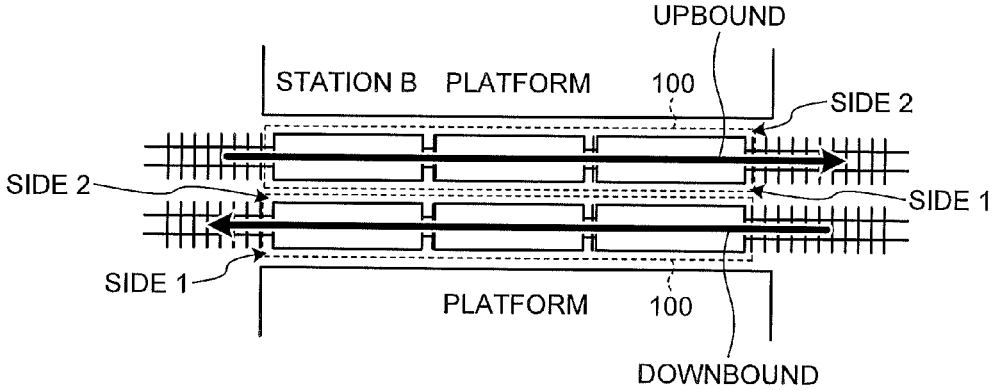
Figure 3:
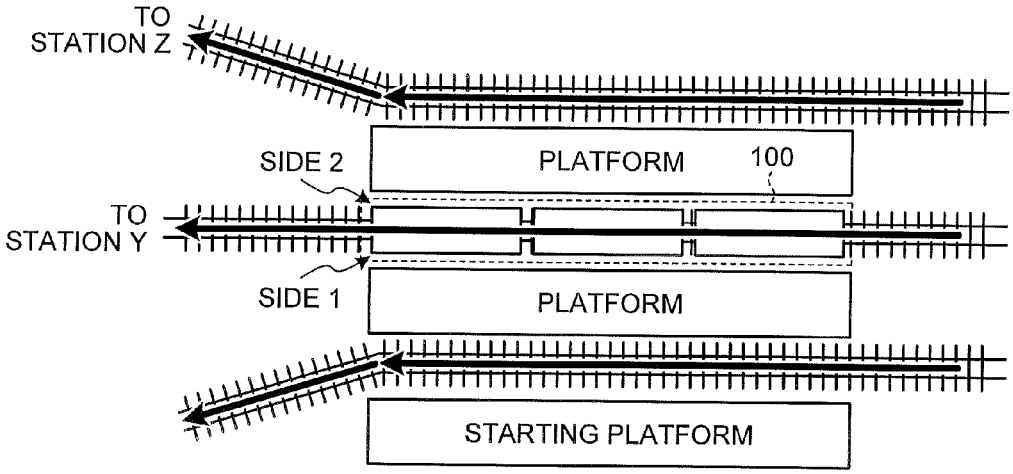

FIG. 3 are examples of a platform configuration of a station explained in the present embodiment. In the examples shown in FIG. 3, a lower side of the respective trains 100 is defined as "Side 1", and an upper side of the respective trains 100 is defined as "Side 2".

FIG. 3(*a*) depicts a platform configuration of a station where a platform is arranged between two railway tracks. In the present embodiment, the platform configuration shown in FIG. 3(*a*) is defined as "island platform". In the example shown in FIG. 3(*a*), it is assumed that a direction of arrow on the upper railway track is upbound and a direction of arrow on the lower railway track is downbound.

FIG. 3(*b*) depicts a platform configuration of a station where platforms are installed, putting two railway tracks therebetween. In the present embodiment, the platform configuration shown in FIG. 3(*b*) is defined as "separate platforms". In the example shown in FIG. 3(*b*), it is assumed that a direction of arrow on the upper railway track is upbound, and a direction of arrow on the lower railway track is downbound.

FIG. 3(*c*) depicts a platform configuration of a station where platforms are arranged between two or more railway tracks. There is a platform configuration of a station having two or more tracks other than the configuration shown in FIG. 3(*c*). However, in the present embodiment, a platform configuration different from the island platform shown in FIG. 3(*a*) and the separate platforms shown in FIG. 3(*b*) as shown in FIG. 3(*c*) is defined as "other platforms". In the example shown in FIG. 3(*c*), it is assumed that all the directions of arrows on all the railway tracks are upbound.

Figure 4:
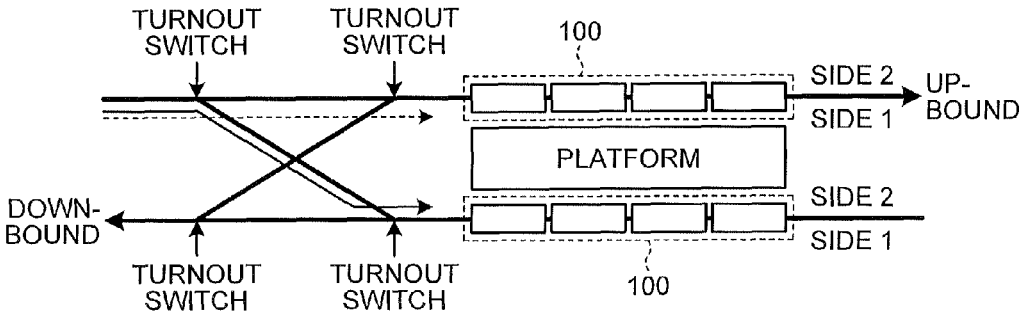
FIG. 4 is an example of a station having an island platform capable of performing a shuttle operation.

FIG. 4 is an example of a station having an island platform capable of performing a shuttle operation. In the example shown in FIG. 4, it is assumed that a lower side of each train is "Side 1" and an upper side of each train is "Side 2", as in FIG. 3.

When the train 100 traveling upbound arrives at a station shown in FIG. 4 and keeps traveling upbound, the train 100 travels forward as shown by a dotted arrow and arrives at an upper platform shown in FIG. 4. In this case, doors on Side 1 open. On the other hand, when the train 100 traveling upbound arrives at the station shown in FIG. 4, and turns back to travel downbound, the train 100 travels forward as shown by a solid arrow and arrives at a lower platform shown in FIG. 4. In this case, doors on Side 2 open. That is, in a station having an island platform, when the traveling direction at the present moment and a door opening direction at the next station are determined, the station facility images to be displayed on the respective display units 1*a* and 1*b* are determined.

Figure 5:
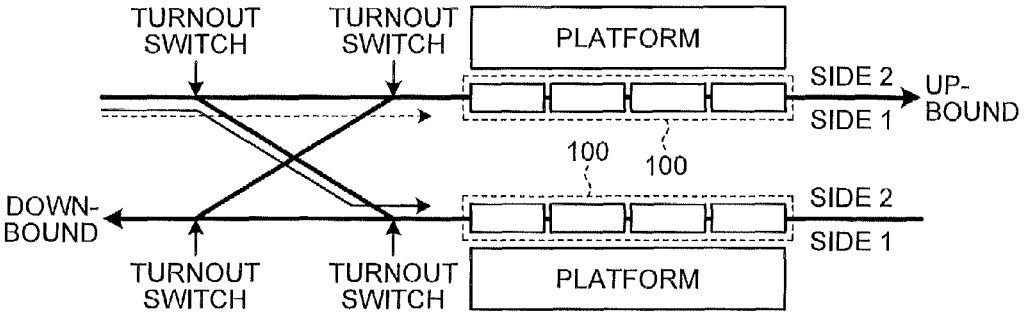
FIG. 5 is an example of a station having separate platforms capable of performing a shuttle operation.

FIG. 5 is an example of a station having separate platforms capable of performing a shuttle operation. Also in the example shown in FIG. 5, it is assumed that a lower side of each train is "Side 1" and an upper side of each train is "Side 2", as in FIG. 3 and FIG. 4.

When the train 100 traveling upbound arrives at a station shown in FIG. 5 and keeps traveling upbound, the train 100 travels forward as shown by a dotted arrow and arrives at an upper platform shown in FIG. 5. In this case, doors on Side 2 open. On the other hand, when the train 100 traveling upbound arrives at the station shown in FIG. 4, and turns back to travel downbound, the train 100 travels forward as shown by a solid arrow and arrives at a lower platform in FIG. 5. In this case, doors on Side 1 open. That is, even in a station having separate platforms, when the traveling direction at the present moment and a door opening direction at the next station are determined, the station facility images to be displayed on the respective display units 1*a* and 1*b* are determined, as in the station having an island platform.

Therefore, when the next station has an island platform or separate platforms, the image-display control unit 7 can select the station facility images to be displayed on the respective display units 1*a* and 1*b*, by acquiring the train information 30 including at least the next station, traveling direction at the present moment, and door opening direction at the next station from the train information management apparatus 3.

On the other hand, when the next station is a station having other platforms, other than the island platform and the separate platforms, for example, as shown in FIG. 3(*c*), such a case is possible that the traveling direction is the same and the door opening direction is also the same. Even in this case, it is general that the arrival platform is determined according to the destination. Accordingly, the image-display control unit 7 can select the station facility images to be displayed on the respective display units 1*a* and 1*b* by acquiring the train information 30 further including a destination station name from the train information management apparatus 3.

For example, as shown in FIG. 3(*c*), even when a starting station of a train being stopped is the station in question, a starting platform of a first train is normally determined. Accordingly, the image-display control unit 7 can select the station facility images to be displayed on the respective display units 1*a* and 1*b* by acquiring the train information 30 further including whether the station in question is a starting station from the train information management apparatus 3.

Figure 6:
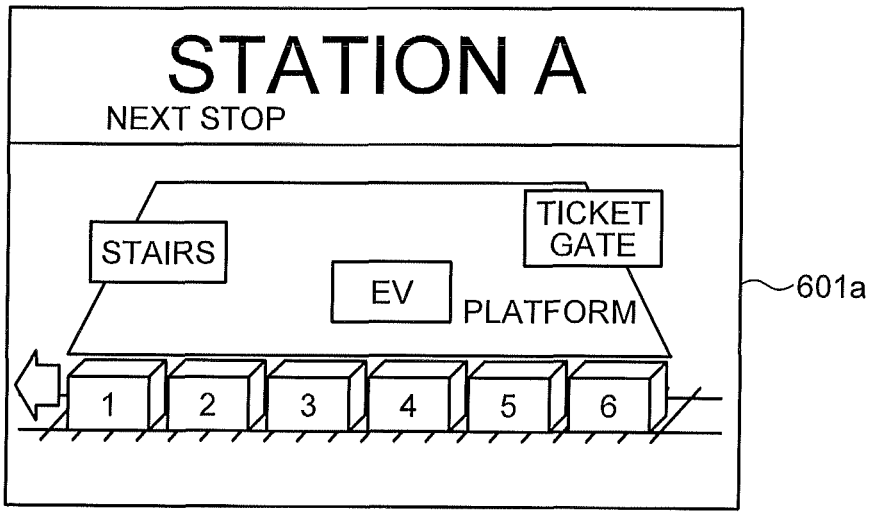
FIG. 6 are examples of a station facility image registered in a station-facility image database.
Figure 6:
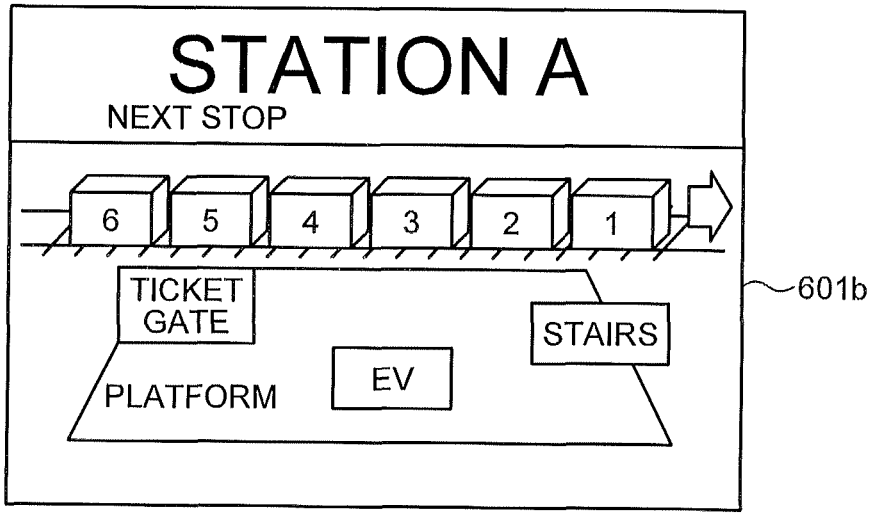

FIG. 6 are examples of a station facility image registered in a station-facility image database. In the examples shown in FIG. 6, a case where the next station is Station A having an island platform shown in FIG. 3(*a*), the traveling direction is upbound, and the door opening direction is Side 1 is shown. A station facility image 601*a* shown in FIG. 6(*a*) is a station facility image displayed on the respective display units 1*a* on Side 1, and a station facility image 601*b* shown in FIG. 6(*b*) is a station facility image displayed on the respective display units 1*b* on Side 2.

As shown in WIG. 6(*a*), the next station name is displayed in an upper part of a screen of the respective display units 1*a* in the door opening direction (here, Side 1), and the station facility image 601*a* in which the train is arranged on the near side and the platform and the station facilities on the platform (for example, stairs and elevators (indicated by "EV" in FIG. 6(*a*)) are arranged on the far side is displayed in a lower part of the screen. The next station name is displayed in the upper part of a screen of the respective display units 1*b* on the opposite side to the door opening direction (here, Side 2), and the station facility image 601*b* in which the platform and the station facilities on the platform are arranged on the near side and the train is arranged on the far side is displayed in the lower part of the screen.

FIG. 7 is an example of the station-facility image database according to the present embodiment. In the example shown in FIG. 7, station A has the island platform shown in FIG. 3(*a*), Station B has the separate platforms shown in FIG. 3(*b*), and Station C has the other platforms shown in FIG. 3(*c*). In the station-facility image database 6, a plurality of station facility images (here, the station facility image displayed on the respective display units 1*a* on Side 1, and the station facility image displayed on the respective display units 1*b* on Side 2 in a pair) are registered for each station, and are stored and held together with station-facility image data numbers, respectively.

FIG. 8 is an example of a station-facility image management table according to the present embodiment. In the example shown in FIG. 8, station-facility image selection conditions including the next station name, traveling direction, starting flag, destination station name, and door opening direction are associated with the station facility images by station-facility image data numbers and stored and held in the station-facility image management table 5.

The station-facility image management table 5 and the station-facility image database 6 can be updated according to need, when the station facility of each station is changed or when the station-facility image selection conditions such as the destination station are changed.

An operation of the in-vehicle information providing apparatus according to the present embodiment will be explained next with reference to FIGS. 2, 7, and 8.

For example, when the next station is Station A, the traveling direction is upbound, and the door opening direction is Side 1, the image-display control unit 7 refers to the station-facility image management table 5 to select a station-facility image data number "1", and selects the respective station facility images 601*a* and 601*b* corresponding to the station-facility image data number "1" from the station-facility image database 6. The image-display control unit 7 then transmits the station facility image 601*a* to the respective display units 1*a* on Side 1 of respective vehicles as the station-facility image information 70*a*, and transmits the station facility image 601*b* to the respective display units 1*b* on Side 2 of the respective vehicles as the station-facility image information 70*b*.

For example, when the next station is Station A, the traveling direction is downbound, and the door opening direction is Side 2, the image-display control unit 7 refers to the station-facility image management table 5 to select a station-facility image data number "2", and selects respective station facility images 602*a* and 602*b* corresponding to the station-facility image data number "2" from the station-facility image database 6. The image-display control unit 7 then transmits the station facility image 602*a* to the respective display units 1*a* on Side 1 of the respective vehicles as the station-facility image information 70*a*, and transmits the station facility image 602*b* to the respective display units 1*b* on Side 2 of the respective vehicles as the station-facility image information 70*b*.

For example, when the next station is Station A, the traveling direction is upbound, and the door opening direction is Side 2, the image-display control unit 7 refers to the station-facility image management table 5 to select a station-facility image data number "3", and selects respective station facility images 603*a* and 603*b* corresponding to the station-facility image data number "3" from the station-facility image database 6. The image-display control unit 7 then transmits the station facility image 603*a* to the respective display units 1*a* on Side 1 of the respective vehicles as the station-facility image information 70*a*, and transmits the station facility image 603*b* to the respective display units 1*b* on Side 2 of the respective vehicles as the station-facility image information 70*b*.

For example, when the next station is Station A, the traveling direction is downbound, and the door opening direction is Side 1, the image-display control unit 7 refers to the station-facility image management table 5 to select a station-facility image data number "4", and selects respective station facility images 604*a* and 604*b* corresponding to the station-facility image data number "4" from the station-facility image database 6. The image-display control unit 7 then transmits the station facility image 604*a* to the respective display units 1*a* on Side 1 of the respective vehicles as the station-facility image information 70*a*, and transmits the station facility image 604*b* to the respective display units 1*b* on Side 2 of the respective vehicles as the station-facility image information 70*b*.

For example, when the next station is Station B, the traveling direction is upbound, and the door opening direction is Side 2, the image-display control unit 7 refers to the station-facility image management table 5 to select a station-facility image data number "5", and selects respective station facility images 605*a* and 605*b* corresponding to the station-facility image data number "5" from the station-facility image database 6. The image-display control unit 7 then transmits the station facility image 605*a* to the respective display units 1*a* on Side 1 of the respective vehicles as the station-facility image information 70*a*, and transmits the station facility image 605*b* to the respective display units 1*b* on Side 2 of the respective vehicles as the station-facility image information 70*b*.

For example, when the next station is Station B, the traveling direction is downbound, and the door opening direction is Side 1, the image-display control unit 7 refers to the station-facility image management table 5 to select a station-facility image data number "6", and selects respective station facility images 606*a* and 606*b* corresponding to the station-facility image data number "6" from the station-facility image database 6. The image-display control unit 7 then transmits the station facility image 606*a* to the respective display units 1*a* on Side 1 of the respective vehicles as the station-facility image information 70*a*, and transmits the station facility image 606*b* to the respective display units 1*b* on Side 2 of the respective vehicles as the station-facility image information 70*b*.

For example, when the next station is Station B, the traveling direction is upbound, and the door opening direction is Side 1, the image-display control unit 7 refers to the station-facility image management table 5 to select a station-facility image data number "7", and selects respective station facility images 607*a* and 607*b* corresponding to the station-facility image data number "7" from the station-facility image database 6. The image-display control unit 7 then transmits the station facility image 607*a* to the respective display units 1*a* on Side 1 of the respective vehicles as the station-facility image information 70*a*, and transmits the station facility image 607*b* to the respective display units 1*b* on Side 2 of the respective vehicles as the station-facility image information 70*b*.

For example, when the next station is Station B, the traveling direction is downbound, and the door opening direction is Side 2, the image-display control unit 7 refers to the station-facility image management table 5 to select a station-facility image data number "8", and selects respective station facility images 608*a* and 608*b* corresponding to the station-facility image data number "8" from the station-facility image database 6. The image-display control unit 7 then transmits the station facility image 608*a* to the respective display units 1*a* on Side 1 of the respective vehicles as the station-facility image information 70*a*, and transmits the station facility image 608*b* to the respective display units 1*b* on Side 2 of the respective vehicles as the station-facility image information 70*b*.

For example, when the next station is Station C, the traveling direction is downbound, the door opening direction is Side 1, and the destination station name is Station Z, the image-display control unit 7 refers to the station-facility image management table 5 to select a station-facility image data number "9", and selects respective station facility images 609*a* and 609*b* corresponding to the station-facility image data number "9" from the station-facility image database 6. The image-display control unit 7 then transmits the station facility image 609*a* to the respective display units 1*a* on Side 1 of the respective vehicles as the station-facility image information 70*a*, and transmits the station facility image 609*b* to the respective display units 1*b* on Side 2 of the respective vehicles as the station-facility image information 70*b*.

For example, when the next station is Station C, the traveling direction is downbound, the door opening direction is Side 1, and the destination station name is Station Y, the image-display control unit 7 refers to the station-facility image management table 5 to select a station-facility image data number "10", and selects respective station facility images 610*a* and 610*b* corresponding to the station-facility image data number "10" from the station-facility image database 6. The image-display control unit 7 then transmits the station facility image 610*a* to the respective display units 1*a* on Side 1 of the respective vehicles as the station-facility image information 70*a*, and transmits the station facility image 610*b* to the respective display units 1*b* on Side 2 of the respective vehicles as the station-facility image information 70*b*.

For example, when the next station is Station C, the traveling direction is downbound, the door opening direction is Side 1, and the station is a starting station, the image-display control unit 7 refers to the station-facility image management table 5 to select a station-facility image data number "11", and selects respective station facility images 611*a* and 611*b* corresponding to the station-facility image data number "11" from the station-facility image database 6. The image-display control unit 7 then transmits the station facility image 611*a* to the respective display units 1*a* on Side 1 of the respective vehicles as the station-facility image information 70*a*, and transmits the station facility image 611*b* to the respective display units 1*b* on Side 2 of the respective vehicles as the station-facility image information 70*b*.

When the respective pieces of information included in the train information 30 output from the train information management apparatus 3 do not match with the station-facility image selection conditions held in the station-facility image management table 5, the image-display control unit 7 transmits an attention seeking image indicating that the door opening direction is unknown to the respective display units 1*a* and 1*b* of the respective vehicles as image information instead of the station-facility image information 70*a* and the station-facility image information 70*b*.

As explained above, according to the in-vehicle information providing apparatus according to the present embodiment, by referring to the station-facility image management table in which the station-facility image selection conditions including at least the station name, traveling direction, and door opening direction are associated with the station facility images, a station facility image in which the train information acquired from the train information management apparatus and the station-facility image selection conditions are matched with each other is selected from the station-facility image database in which the plurality of station facility images are registered for each station and displayed on the respective display units. Accordingly, a station facility information display function can be realized without any need to establish any large-scale system.

When a train diagram is disturbed and a shuttle operation is performed from a station on the way, even when the predetermined arrival platform is changed, a station facility image of the arrival platform can be selected based on the door opening direction, and more reliable station facility information can be displayed.

Furthermore, when the respective pieces of information included in the train information output from the train information management apparatus and the station-facility image selection conditions held in the station-facility image management table do not match with each other, an attention seeking image indicating that the door opening direction is unknown is displayed on the respective display units. Accordingly, erroneous display such that a station facility image different from the actual station facility is displayed can be prevented.

In the embodiment described above, a configuration in which the in-vehicle information providing apparatus includes the image-display control unit, and the station-facility image information is transmitted to the display units has been explained. However, the present invention is not limited thereto, and such a configuration is also possible that the display unit has a function corresponding to the image-display control unit, and the train information from the train information management apparatus is input to the display unit so as to select the respective station facility images to be displayed on the respective display units from the station-facility image database by referring to the station-facility image management table stored in the storage unit.

The configuration according to the above embodiment is only a configuration example of the present invention, and it is needless to mention that the configuration can be combined with other well-known techniques, and it can be modified without departing from the scope of the invention, such as omitting a part the configuration.

REFERENCE SIGNS LIST

1*a*, 1*b* display unit
2 in-vehicle information providing apparatus
3 train information management apparatus
4 storage unit
5 station-facility image management table
6 station-facility image database
7 image-display control unit
30 train information
70*a*, 70*b* station-facility image information
100 train
601*a*, 601*b*, 602*a*, 602*b*, 603*a*, 603*b*, 604*a*, 604*b*, 605*a*, 605*b*, 606*a*, 606*b*, 607*a*, 607*b*, 608*a*, 608*b*, 609*a*, 609*b*, 610*a*, 610*b*, 611*a*, 611*b* station facility image

The invention claimed is:

1. An in-vehicle information providing apparatus that causes a plurality of display units installed in a vehicle to display a station facility image of a next station, the in-vehicle information providing apparatus comprising:

a storage unit that stores therein a station-facility image management table in which station-facility image selection conditions including at least a station name, a traveling direction, and a door opening direction are associated with the station facility image, and a station-facility image database in which a plurality of station facility images corresponding to the station-facility image selection conditions are registered for each station; and an image-display control unit that selects, from the station-facility image database, the station facility image associated with the station-facility image selection conditions when train information acquired from a train information management apparatus matches with the station-facility image selection conditions, by referring to the station-facility image management table, and transmits the selected station facility image as station-facility image information to the respective display units.

2. The in-vehicle information providing apparatus according to claim 1, wherein the station-facility image management table further includes a destination station name of the train in the station-facility image selection conditions.

3. The in-vehicle information providing apparatus according to claim 1, wherein the station-facility image management table further includes whether the station is a starting station in the station-facility image selection conditions.

4. The in-vehicle information providing apparatus according to claim 2, wherein the station-facility image management table further includes whether the station is a starting station in the station-facility image selection conditions.

5. The in-vehicle information providing apparatus according to claim 1, wherein when the station facility image in which the train information and the station-facility image selection conditions match with each other is not registered in the station-facility image database, the image-display control unit transmits an attention seeking image indicating that a door opening direction at a next station is unknown to the respective display units, as image information instead of the station-facility image information.

6. The in-vehicle information providing apparatus according to claim 2, wherein when the station facility image in which the train information and the station-facility image selection conditions match with each other is not registered in the station-facility image database, the image-display control unit transmits an attention seeking image indicating that a door opening direction at a next station is unknown to the respective display units, as image information instead of the station-facility image information.

7. The in-vehicle information providing apparatus according to claim 3, wherein when the station facility image in which the train information and the station-facility image selection conditions match with each other is not registered in the station-facility image database, the image-display control unit transmits an attention seeking image indicating that a door opening direction at a next station is unknown to the respective display units, as image information instead of the station-facility image information.

8. The in-vehicle information providing apparatus according to claim 4, wherein when the station facility image in which the train information and the station-facility image selection conditions match with each other is not registered in the station-facility image database, the image-display control unit transmits an attention seeking image indicating that a door opening direction at a next station is unknown to the respective display units, as image information instead of the station-facility image information.

9. The in-vehicle information providing apparatus according to claim 1, wherein one or both of the station-facility image management table and the station-facility image database are rewritable.

10. The in-vehicle information providing apparatus according to claim 2, wherein one or both of the station-facility image management table and the station-facility image database are rewritable.

11. The in-vehicle information providing apparatus according to claim 3, wherein one or both of the station-facility image management table and the station-facility image database are rewritable.

12. The in-vehicle information providing apparatus according to claim 4, wherein one or both of the station-facility image management table and the station-facility image database are rewritable.

13. The in-vehicle information providing apparatus according to claim 5, wherein one or both of the station-facility image management table and the station-facility image database are rewritable.

14. The in-vehicle information providing apparatus according to claim 6, wherein one or both of the station-facility image management table and the station-facility image database are rewritable.

15. The in-vehicle information providing apparatus according to claim 7, wherein one or both of the station-facility image management table and the station-facility image database are rewritable.

16. The in-vehicle information providing apparatus according to claim 8, wherein one or both of the station-facility image management table and the station-facility image database are rewritable.

* * * * *